US007463835B2

(12) United States Patent
Harumoto

(10) Patent No.: US 7,463,835 B2
(45) Date of Patent: Dec. 9, 2008

(54) IMAGE FORMING APPARATUS HAVING PROCESS CARTRIDGES WITH IDENTIFIED PARTS

(75) Inventor: Katsumi Harumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 103 days.

(21) Appl. No.: 11/635,054

(22) Filed: Dec. 7, 2006

(65) Prior Publication Data

US 2007/0264032 A1 Nov. 15, 2007

(30) Foreign Application Priority Data

May 9, 2006 (JP) ..... 2006-130497

(51) Int. Cl.
*G03G 15/00* (2006.01)
*G03G 21/00* (2006.01)
*G03G 21/16* (2006.01)

(52) U.S. Cl. ..... 399/12; 399/13; 399/110

(58) Field of Classification Search ..... 399/12, 399/13, 110, 111, 112, 124, 125, 299; 347/138, 347/152

See application file for complete search history.

(56) References Cited

U.S. PATENT DOCUMENTS 6,993,268 B2 * 1/2006 Otaka ..... 399/124
7,319,827 B2 * 1/2008 Yoshizawa ..... 399/12
2005/0095017 A1 * 5/2005 Kikuchi ..... 399/12
2006/0083543 A1 * 4/2006 Sunohara ..... 399/110
2006/0291897 A1 * 12/2006 Ozawa ..... 399/110
2007/0189781 A1 * 8/2007 Katogi et al. ..... 399/12

FOREIGN PATENT DOCUMENTS

JP 2005-128414 A 5/2005

* cited by examiner

*Primary Examiner*—Sophia S Chen
(74) *Attorney, Agent, or Firm*—Sughrue Mion, PLLC

(57) ABSTRACT

An image forming apparatus includes: process cartridges removably provided at an apparatus-main-body; a conveyance belt facing the process cartridges; a cover member provided at the apparatus-main-body capable of opening/closing with respect to the apparatus-main-body. The apparatus also includes identified parts respectively provided at the process cartridges with the shapes and/or placements thereof being different from each other and respective colors corresponding to the process cartridges. Identification parts are provided at the apparatus-main-body corresponding to the respective identified parts, that show, whether or not the process cartridges are attached at respective proper-setting-positions by interfering or not interfering with the respective identified parts. A conveyance belt refuge member allows the conveyance belt to move toward the cover member when the cover member is closed if at least one of the process cartridge is not attached at the proper-setting-position.

16 Claims, 9 Drawing Sheets

IMAGE FORMING APPARATUS HAVING PROCESS CARTRIDGES WITH IDENTIFIED PARTS

BACKGROUND

1. Technical Field

The present invention relates to an image forming apparatus in which a cover member is rotatably attached to a main frame, a conveying unit that conveys a recording medium or an intermediate conveying unit to which an image is transferred from a photoreceptor (an image carrier) being attached to the cover member.

2. Related Art

Conventionally, in a color image forming apparatus such as a color copying machine, process cartridges corresponding to toners of plural colors (yellow, magenta, cyan, and black) are attached removably to attach portions of an apparatus main body. The process cartridges are exchanged for new ones according to the mechanical life thereof, etc.

SUMMARY

According to a first aspect of the invention, there is provided an image forming apparatus including: plural process cartridges removably provided at and arranged in tandem manner in an apparatus main body; a conveyance belt facing the process cartridges, that conveys a recording medium; a cover member provided at the apparatus main body so as to be capable of opening and closing with respect to the apparatus main body, a state in which the conveyance belt faces the process cartridges being released so that the process cartridges are exposed when the cover member is opened; identified parts respectively provided at the process cartridges, at least one of shapes and placements thereof being different from each other for respective colors corresponding to the process cartridges; identification parts provided at the apparatus main body so as to correspond to the respective identified parts, that show, when the process cartridges are attached at the apparatus main body, whether or not the process cartridges are attached at respective proper setting positions at the apparatus main body by interfering or not interfering with the respective identified parts; and a conveyance belt refuge member that allows the conveyance belt to move toward the cover member when the cover member is closed in a state in which at least one of the process cartridge is not attached at the proper setting position.

BRIEF DESCRIPTION OF THE DRAWINGS

Exemplary embodiments of the invention will be described in detail with reference to the following figures, wherein.

DETAILED DESCRIPTION

An exemplary embodiment of the present invention will be described in detail below using an example shown in figures. In the figures, when a component is a component which is provided for each color of yellow (Y), magenta (M), cyan (C), and black (K), characters of Y, M, C, and K are appended to the reference numbers of the component in some cases.

Figure 1:
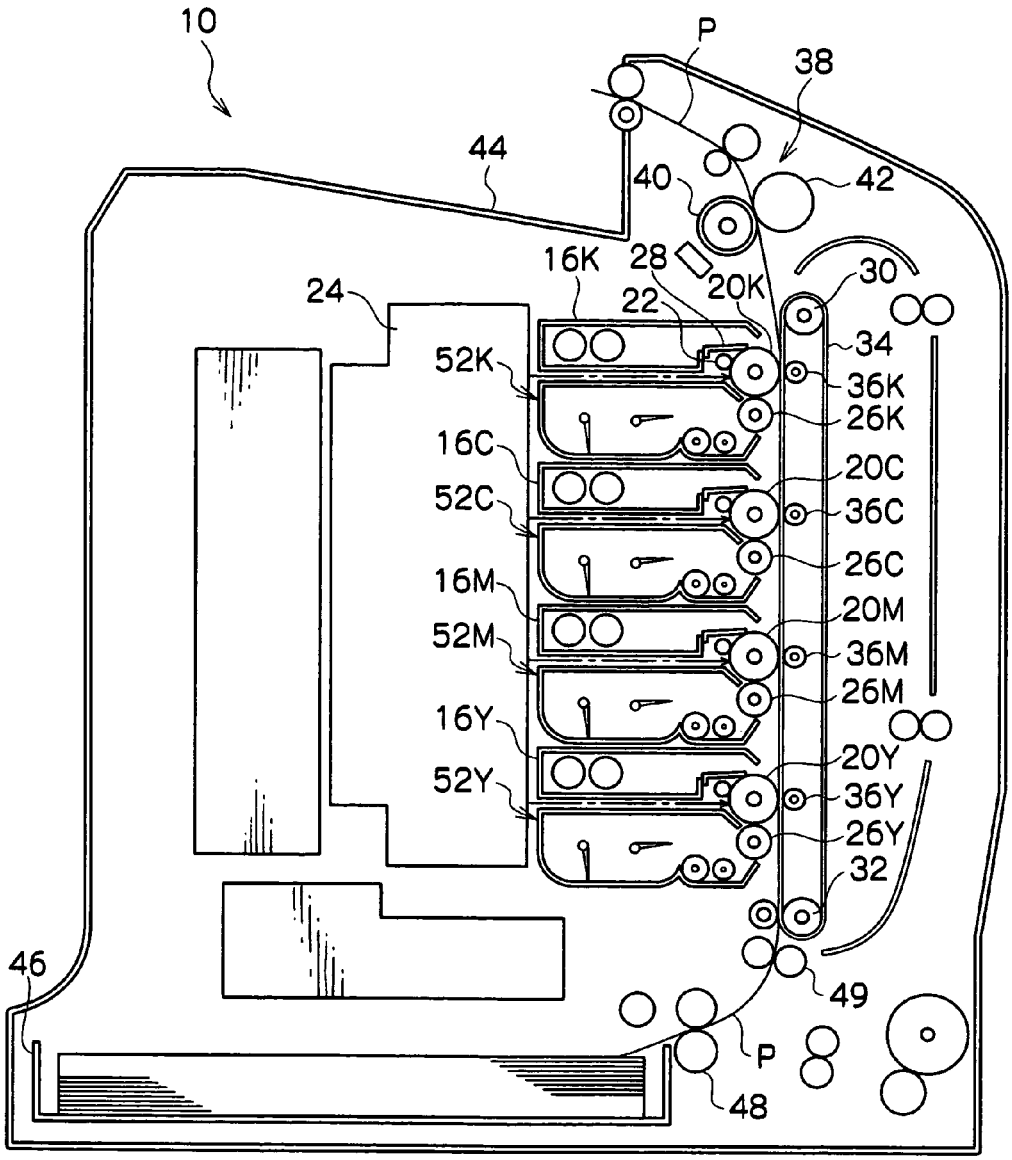
FIG. 1 is a schematic side view showing structure of an image forming apparatus according to an exemplary embodiment of the invention.
Figure 2:
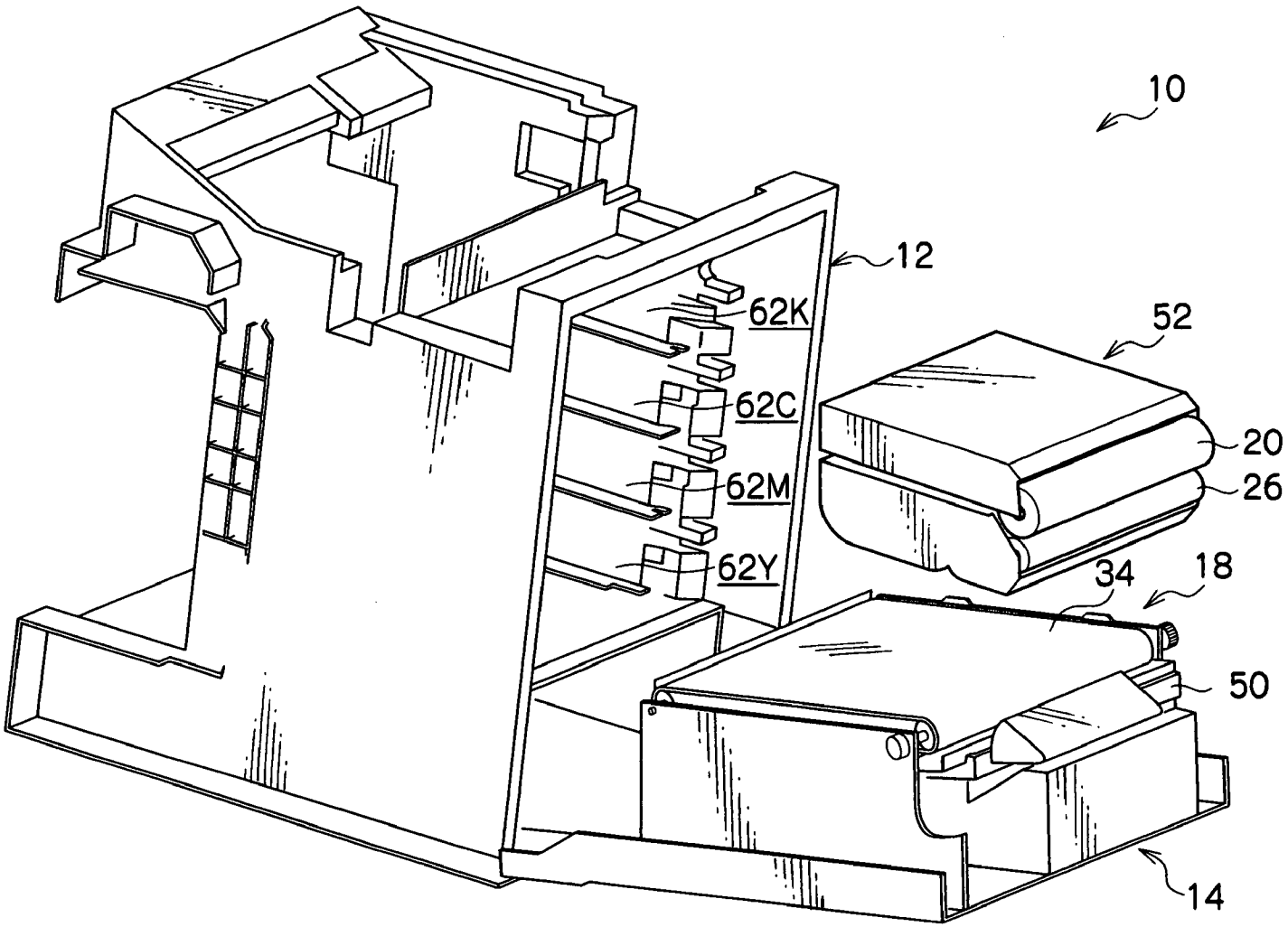
FIG. 2 is a schematic perspective view showing a main frame and a cover equipped with a conveying unit in the image forming apparatus according to the exemplary embodiment of the invention.

First, an outline of an image forming apparatus 10 according to the exemplary embodiment of the invention is described. As shown in FIGS. 1 to 2, the image forming apparatus 10 includes a main body frame 12 that, in attachably and detachably manner, accommodates an image carrier member (a photosensitive member) 20 and a developing unit 16 (hereinafter, there are mentioned as a process cartridge 52), and a cover member 14 for opening or closing the process cartridge 52. The cover member 14 includes a conveyance unit 18 which is attachably and detachably mounted at the cover member 14 and includes a conveyance belt 34 capable of adsorbing a recording paper P for conveying.

Each developing unit 16 includes a charge roller 22 that uniformly charges the surface of the roll-like image carrier member 20, an optical box 24 that forms a latent image by the electrostatic potential difference by irradiating an image beam to the image carrier member 20 on the basis of image data, a developing roller 26 that visualizes the latent image by selectively transferring a toner thereto, and a cleaning member 28 that slides against the image carrier member 20 after transferring of the toner image for cleaning the residual toner on the image carrier member 20.

The image carrier member 20 includes a photosensitive layer on the surface (circumferential surface) thereof. The electrostatic latent image (image) is formed as follows: the surface (circumferential surface) is uniformly charged by the charge roller 22; thereafter, the surface (circumferential surface) is exposed by a laser beam (image beam) irradiated from the optical box 24; and the potential of the exposed portion is attenuated. The charge roller 22 is contacted with the image carrier member 20 for charging the surface (circumferential surface) of the image carrier member 20 substantially uniformly by applying a voltage therebetween and generating electric discharge in a minute space in the vicinity of the contact portion.

The optical box 24 causes a flickering laser beam to be scanned on the surface (circumferential surface) of the image carrier member 20 so as to form an electrostatic latent image based on the image data on the surface (circumferential surface) of the image carrier member 20. As the optical box 24, one having light emitting elements such as an LED arranged for flickering based on the image data or the like can be considered.

The developing roller 26 is disposed facing the image carrier member 20 adjacently for applying a developing bias voltage between the developing roller 26 and the image carrier member 20. Thereby, a developing bias electric field is formed between the developing roller 26 and the image carrier member 20 so that a charged toner is transferred onto the exposed portion on the image carrier member 20 to form a visual image.

On the other hand, the conveyance unit 18 includes a conveyance belt 34 laid across at least a driving roller 30 and a driven roller 32. Plural (4 pieces; corresponding to each of colors which will be described later) transfer rollers 36 are provided at predetermined positions on the inner surface side of the conveyance belt 34 between the driving roller 30 and the driven roller 32 with predetermined intervals therebetween.

The transfer roller 36 faces the image carrier member 20 with the conveyance belt 34 interposed therebetween when the cover member 14 is closed (when the process cartridge 52 is closed by rotating the cover member 14 to the main body frame 12 side). The toner image (unfixed image) on the image carrier member 20 is transferred onto the proceeding (passing) recording paper P which is adsorbed and conveyed by the conveyance belt 34 by forming a transfer electric field between the image carrier member 20 and transfer rollers 36.

Here, the developing units 16 are provided in the vertical direction in the order of for example yellow (Y), magenta (M), cyan (C) and black (K) from below along the conveyance direction of the recording paper P for allowing full color printing. A fixing device 38 is provided at the downstream side (upper part of the main body frame 12) of the recording paper P conveyance direction with respect to the developing units 16Y to 16K.

The fixing device 38 includes a heat roller 40 and a pressure roller 42, facing circumferential surfaces of the heat roller 40 and the pressure roller 42 being pressed (nipped) by a predetermined pressure. By heating and pressuring an unfixed image which is transferred onto the recording paper P with the heat roller 40 and the pressure roller 42, the toner image is fixed on the recording paper P.

The recording paper P with the toner image fixed by heating and pressuring with the fixing device 38 (the heat roller 40 and the pressure roller 42) is discharged onto a paper discharge tray 44. Then, after completing transfer of the toner image onto the recording paper P, the surface (circumferential surface) of the image carrier member 20 is subject to a cleaning process with the cleaning member 28 for preparation to the next image producing process.

Moreover, a removable paper feed cassette 46 is provided in the lower part of the main body frame 12. The paper feed cassette 46 can be pulled out in the direction opposite to the feeding direction of the recording paper P so as to be able to properly supply the recording papers P.

Then, a paper feed roller pair 48 for feeding out the recording papers P one by one from the paper feed cassette 46 is provided in the vicinity of the top end portion of the paper feed cassette 46 so that the recording paper P fed out from the paper feed roller pair 48 is sent out to the adsorb conveyance surface of the conveyance belt 34 by a resist roller pair 49 by a predetermined timing so as to be transported to a transfer position of each color toner image.

Figure 3:
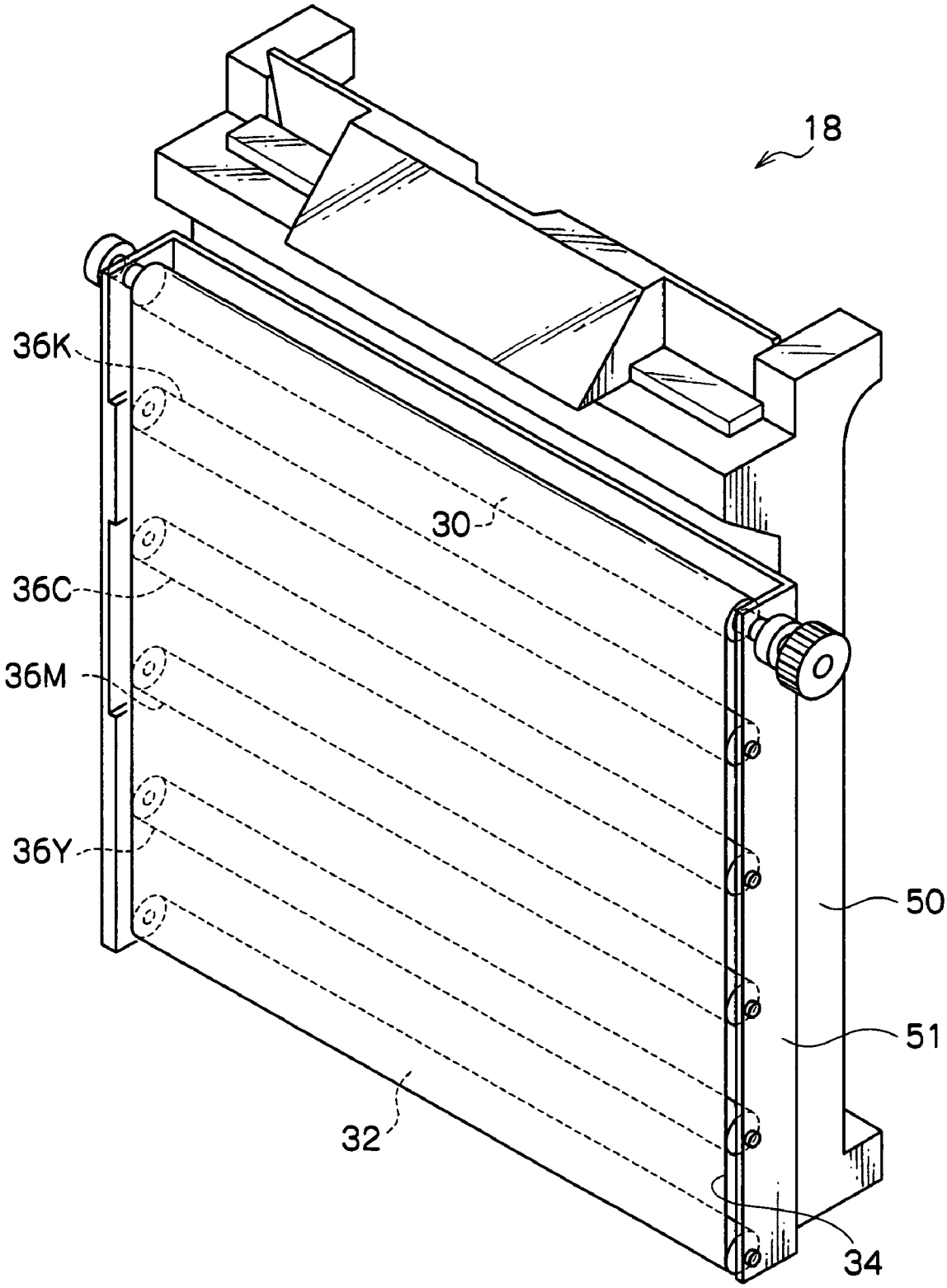
FIG. 3 is a schematic perspective view showing the conveying unit of the image forming apparatus according to the exemplary embodiment of the invention.

The conveyance unit 18 to be mounted removably on the cover member 14 in the image forming apparatus 10 of the configuration mentioned above will be explained in further details. As shown in FIG. 3, the conveyance unit 18 includes a frame 51 having an approximately U-shaped cross section and a substantially flat plate shaped housing 50 that holds the frame 51. In the housing 50, a driving roller 30 is rotatably supported on an upper end part, and the driven roller 32 is rotatably supported on a lower end part. A conveyance belt 34 for electrostatically adsorbing the recording paper P is wound around and laid across the driving roller 30 and the driven roller 32.

Further, transfer rollers 36Y to 36K are provided between the driving roller 30 and the driving roller 32 at the inner surface side of the conveyance belt 34 with predetermined intervals therebetween for each of the colors. Each of the transfer rollers 36Y to 36K is rotatably supported in the flame 51.

Figure 4A:
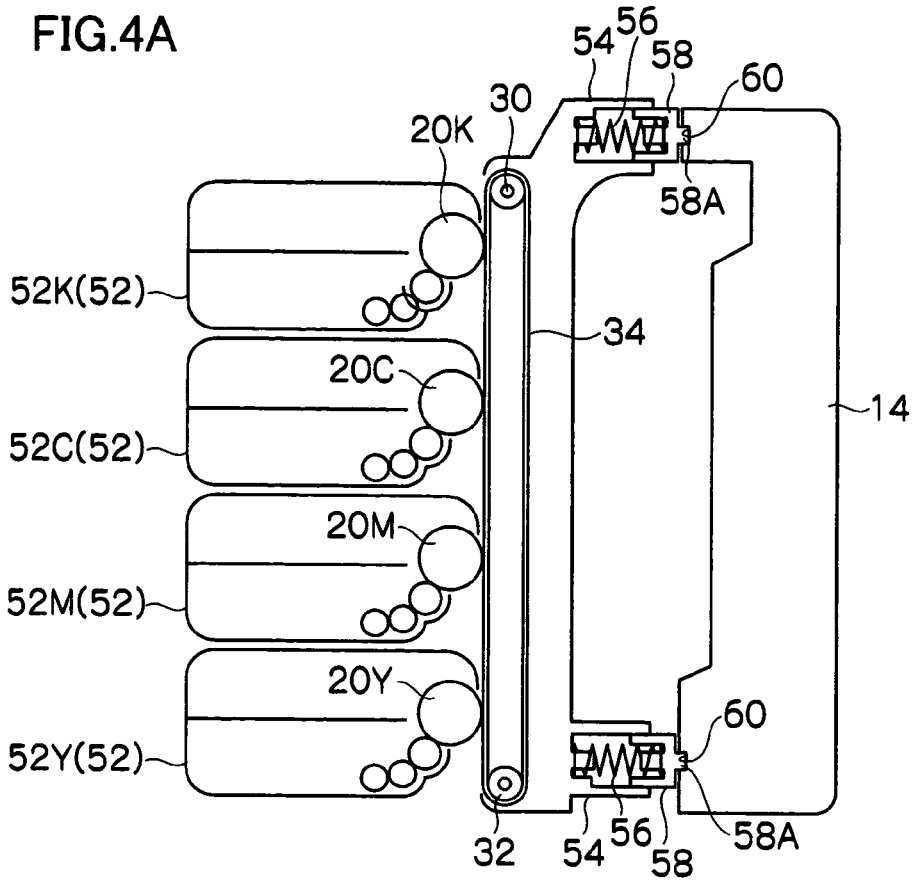
FIGS. 4A and 4B are explanatory views showing a positional relation between process cartridges and the conveying unit of the image forming apparatus according to the exemplary embodiment of the invention.
Figure 4B:
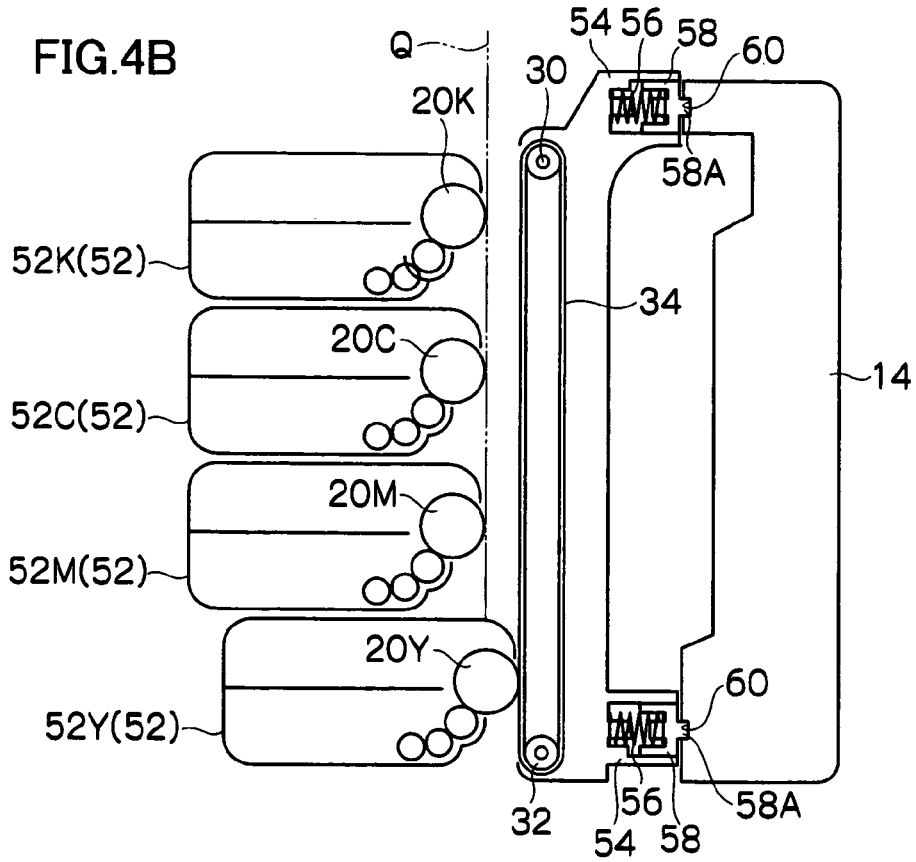

As shown in FIGS. 4A and 4B, horn like legs 54 protrude from the housing 50 to the side opposite to the conveyance belt 34. The legs 54 have a hollow structure, and springs 56 are included therein. One end of the spring 56 is attached to the innermost wall of the leg 54, and the other end of the spring is attached to a connecting member 58 that can be inserted into the leg 54.

Thus, when the connecting member 58 is pressed, the connecting member 58 is inserted into the leg 54 while compressing the spring 56, so that an elastic force is accumulated in the spring 56. Then, when the pressing force on the connecting member 58 is removed, the connecting member 58 is returned to the original position by a biasing force of the spring 56.

A joint portion 58A is formed on the surface of the connecting member 58, and a jointed portion 60, to which the joint portion 58A can be jointed, is formed on the side of the cover 14. The conveying unit 18 is attached to the cover 14 with a state of connecting the joint portion 58A to the jointed portion 60. Thus, the conveying unit 18 is in a floating state with respect to the cover 14 by the springs 56.

When the cover 14 is closed, each of the transfer rollers 36Y to 36K is brought into contact with each of the image carrier members 20Y to 20K under a predetermined pressure by the springs 56 with the conveyance belt 34 interposed therebetween, and is rotated according to running of the conveyance belt 34.

Next, the process cartridges 52, which are removably attached to the main frame 12, will be described in more detail below. As shown in FIGS. 1 and 2, the process cartridges 52 are arranged vertically in the order of yellow (Y), magenta (M), cyan (C), and black (K) from the bottom, and cartridge receiving portions 62Y, 62M, 62C, and 62K are formed in the main frame 12. The process cartridges 52Y, 52M, 52C, 52K are attached to the appropriate cartridge receiving portions 62 respectively.

Figure 5:
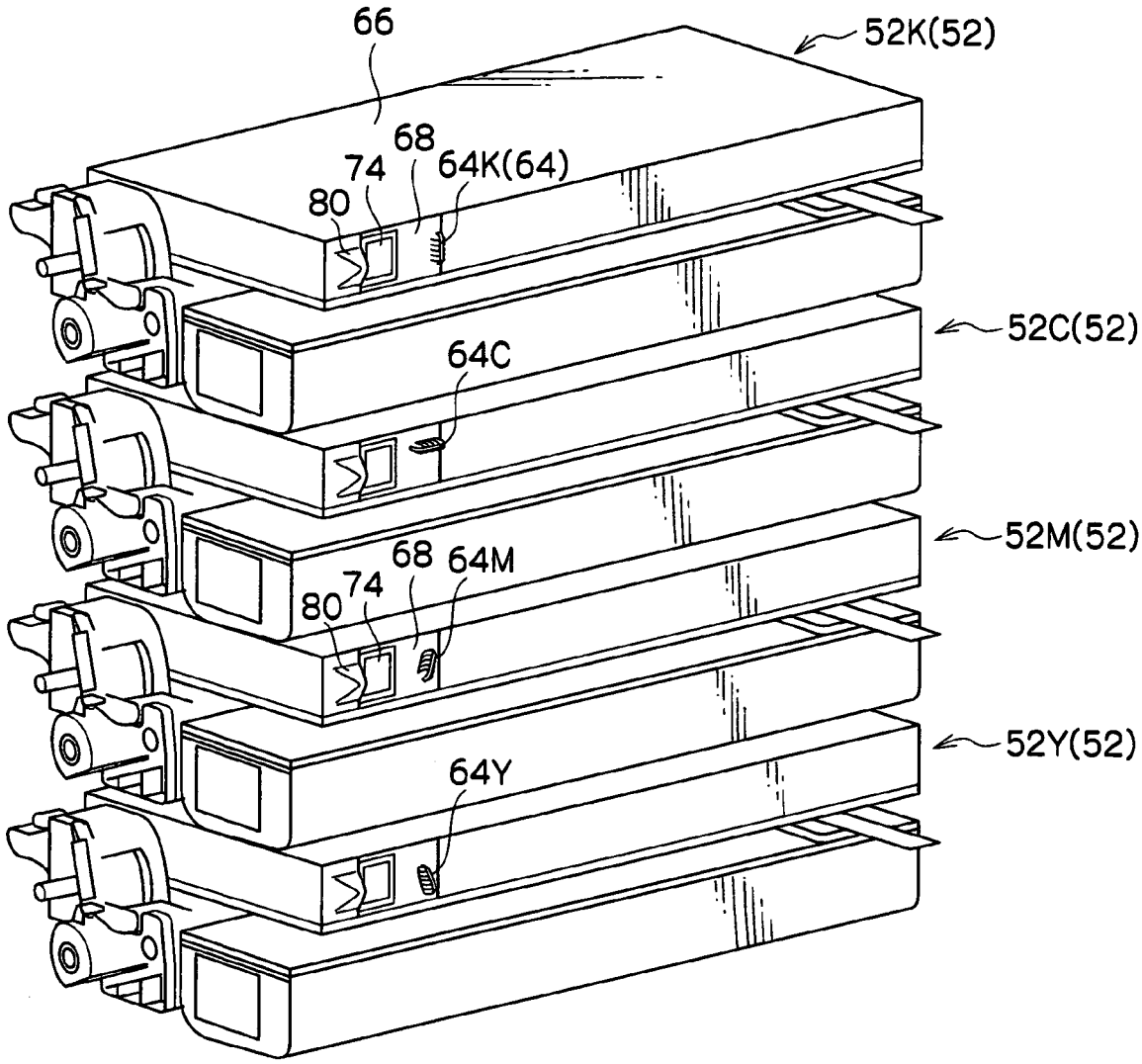
FIG. 5 is a perspective view showing the backside of the process cartridges of the image forming apparatus according to the exemplary embodiment of the invention.

Thus, as shown in FIG. 5, engaging ribs (identified parts) 64Y, 64M, 64C, 64K for each of colors with different shapes are provided on the backsides of the process cartridges 52 respectively. Each engaging rib 64 is provided on a plate (a identified plate) 68 which is independent from a process cartridge body 66, and the plate 68 is replaceable with respect to the process cartridge body 66. The plate 68 may be attached to a side surface, etc. of the process cartridge 52.

For example, the engaging ribs 64 are such that: the engaging rib 64Y extends in a direction inclined to the vertical direction in the process cartridge 52Y; the engaging rib 64M extends in the direction inclined opposite to the engaging rib 64Y in the process cartridge 52M; the engaging rib 64C extends in the horizontal direction in the process cartridge 52C; and the engaging rib 64K extends in the vertical direction in the process cartridge 52K. The engaging ribs 64Y, 64M, 64C, 64K are not limited to the above mentioned example as long as they have different shapes and/or have different placements (for example, different orientations). For example, it is possible that they have the same shape but the different placements.

Figure 6:
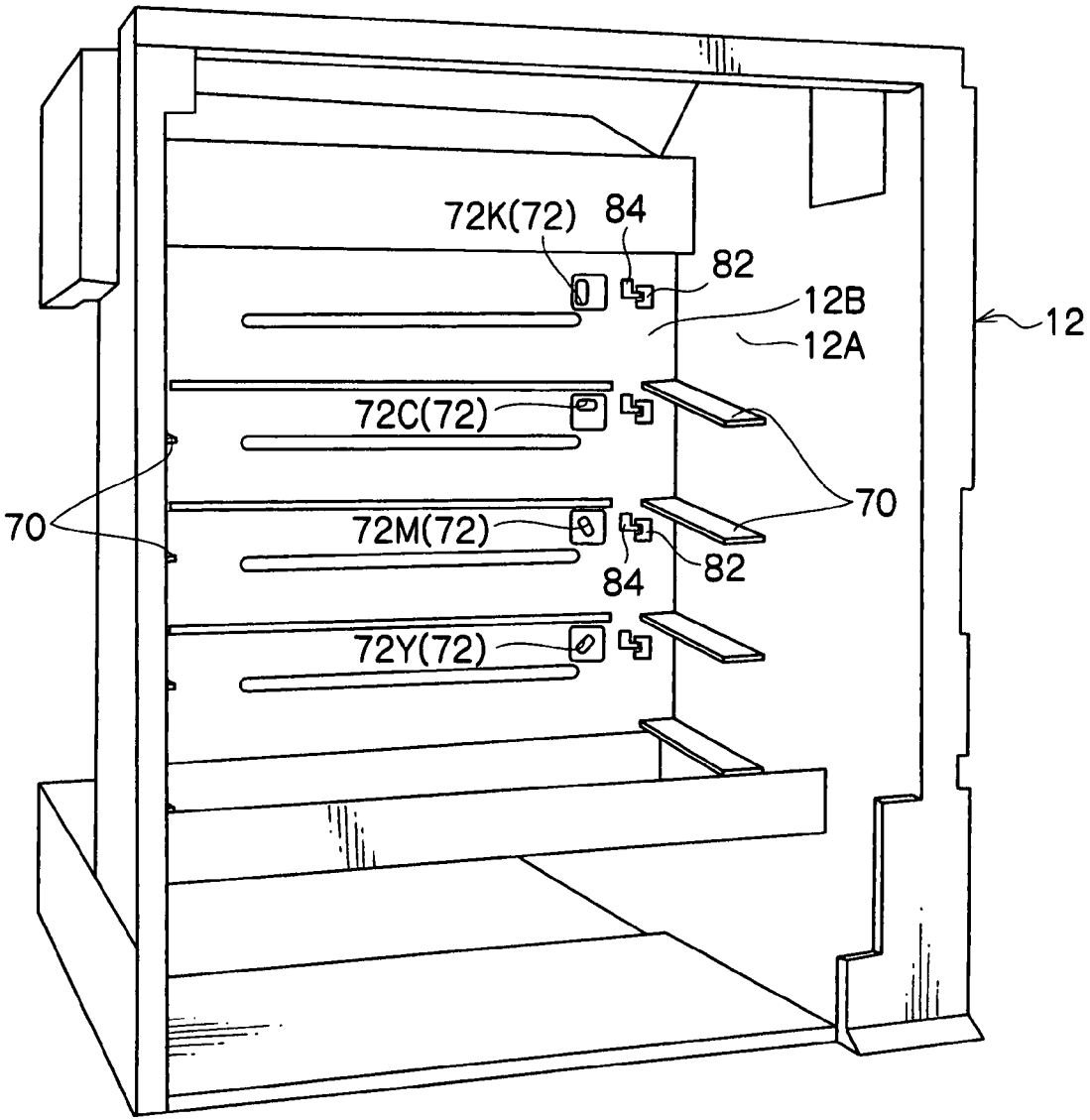
FIG. 6 is a perspective view showing the front side of the main frame of the image forming apparatus according to the exemplary embodiment of the invention.

On the other hand, as shown in FIG. 6, pairs of holding parts 70 protrude from inner side walls 12A of the main frame 12, and they introduce the process cartridges 52 into the main frame 12 and hold the process cartridges 52.

Engaging holes (identification parts) 72 corresponding to the engaging ribs 64 provided on the backsides of the process cartridges 52 held by the holding parts 70 are formed on the innermost wall 12B of the main frame 12. That is, an engaging hole 72Y formed in the direction inclined to the vertical direction, an engaging hole 72M formed in the direction inclined opposite to the engaging hole 72Y, an engaging hole 72C formed in the horizontal direction, and an engaging hole 72K formed in the vertical direction are arranged in this order from the bottom on the innermost wall 12B of the main frame 12. The engaging holes 72Y, 72M, 72C, 72K can engage with the engaging ribs 64Y, 64M, 64C, 64K, respectively.

Therefore, when the process cartridge 52 is attached to a wrong position, the engaging rib 64 cannot engage with the engaging hole 72 because of their different placement (orientations). Therefore, with a state in which the engaging rib 64 abuts with the periphery of the engaging hole 72, movement of the process cartridge 52 is regulated so that the process cartridge 52 cannot be attached to the main flame completely. This can prevent the incorrect attachment of the process cartridge 52.

Though the engaging rib 64 is provided as the identified part and the engaging hole 72 is provided as the identification part in this embodiment, it is not limited to this engaging structure of the engaging rib 64 and the engaging hole 72. It is possible to use another structure as long as the structure is such that the process cartridge 52 side and the main frame 12 side interfere or do not interfere with each other.

Figure 7:
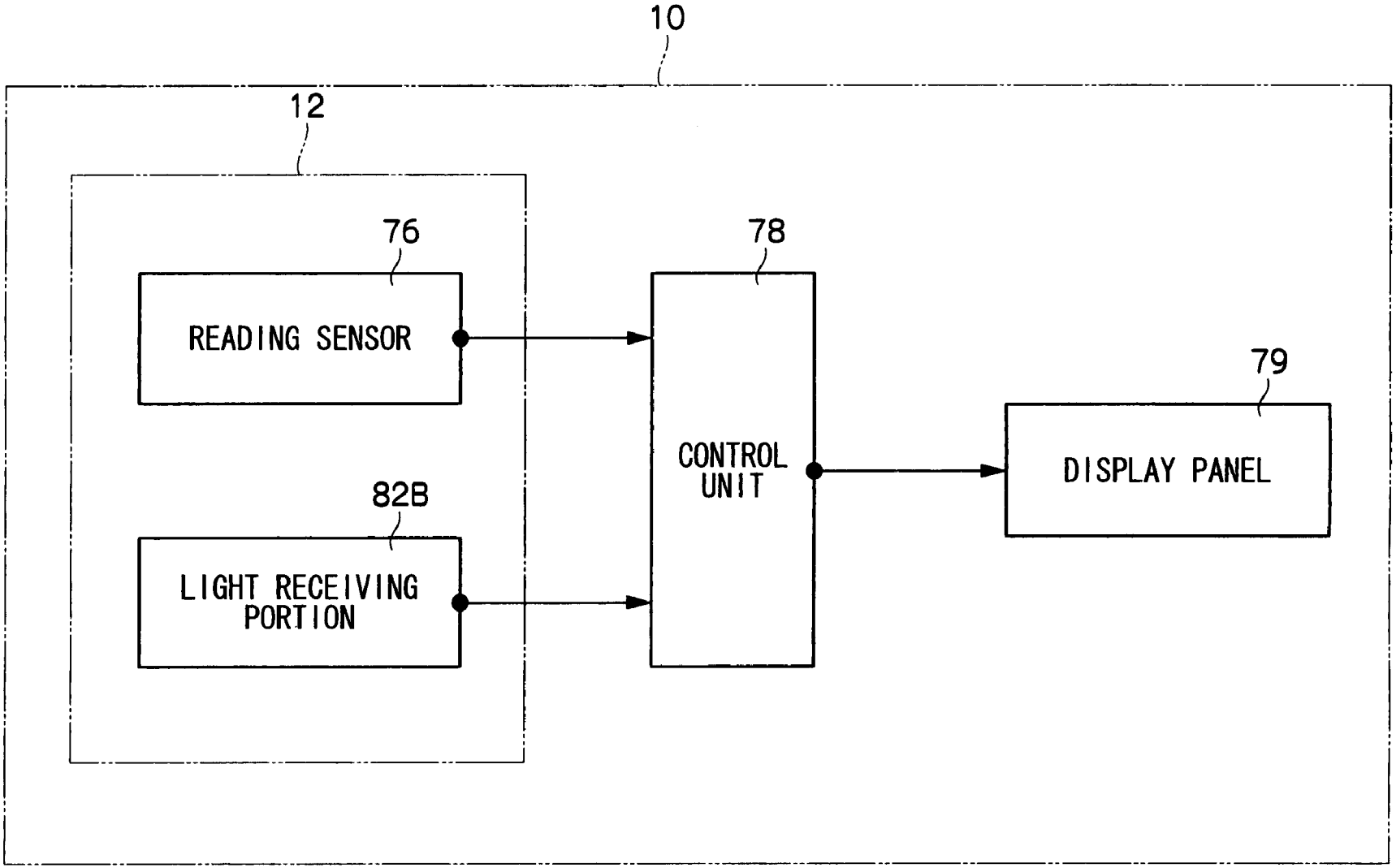
FIG. 7 is a block diagram for illustrating a control unit incorporated in the image forming apparatus according to the exemplary embodiment of the invention.

A region for embedding a memory 74 as an information supplying unit is formed on each plate 68. Information of the color, destination, type, etc. of the toner is stored in the memory 74. When the process cartridge 52 is attached in the main frame 12, the information is read by an information detecting unit of a reading sensor 76 which is disposed on the main frame 12, as shown in FIG. 7. The read information is then sent to a control unit 78 incorporated in the image forming apparatus 10.

Thus, it is confirmed whether the process cartridge 52 is attached according to the predetermined setting. When a wrong process cartridge 52 is attached, an error message is shown on a display panel 79 of the image forming apparatus 10.

Figure 8B:
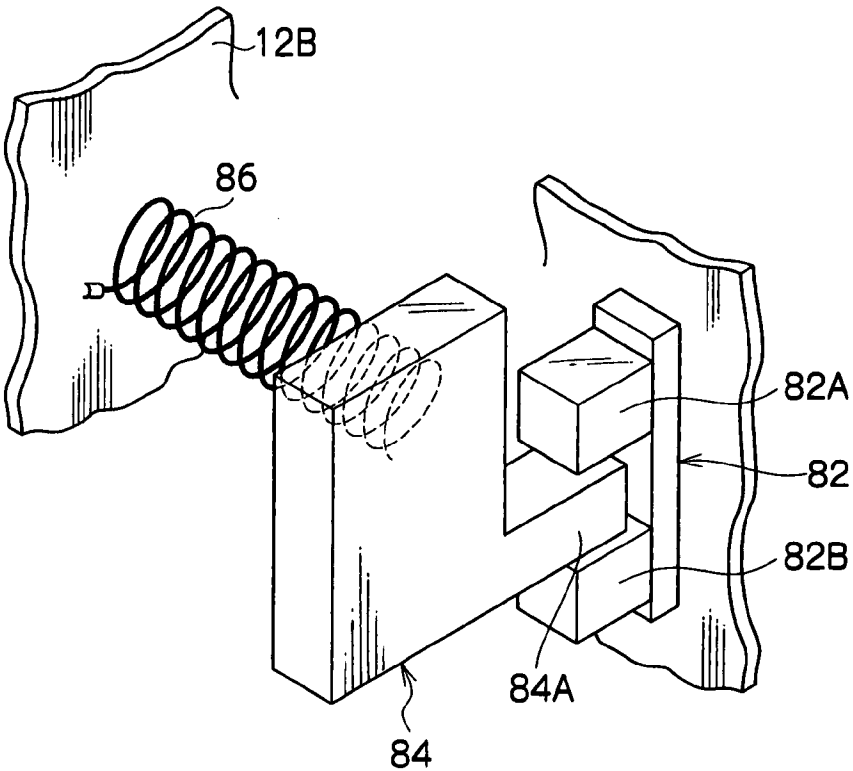
FIGS. 8A and 8B are explanatory views for illustrating the motion of an existence detecting unit incorporated in the image forming apparatus according to the exemplary embodiment of the invention.
Figure 8A:
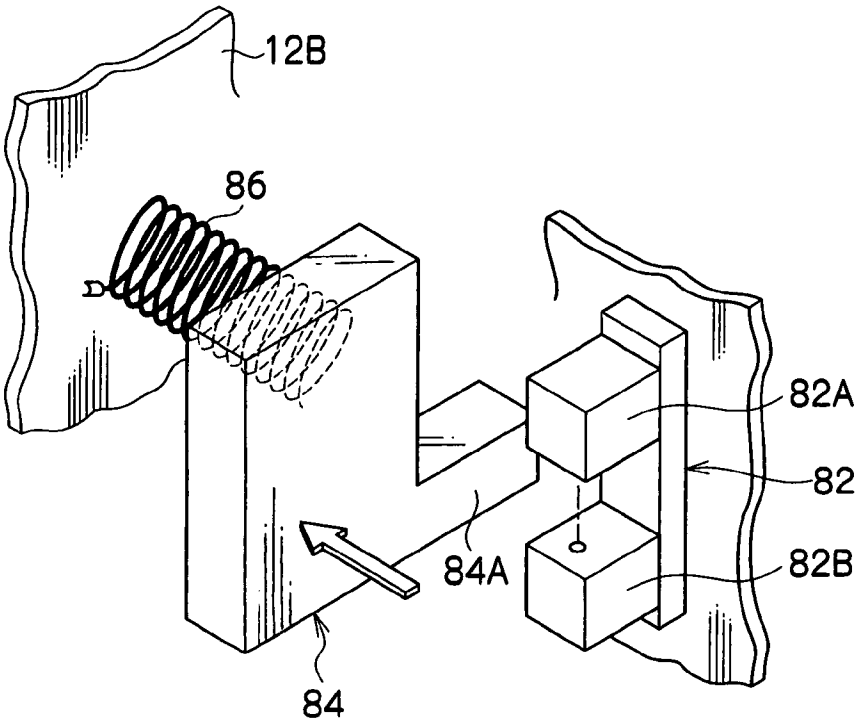

As shown in FIG. 5, a protrusion 80 protrudes from the corner of each process cartridge 52 in the vicinity of the plate 68. Further, as shown in FIGS. 8A and 8B, a light transmission type photo-interruptor 82 is disposed as an existence detecting unit on the innermost wall 12B of the main frame 12 at a position corresponding to the projection 80. Between a light emitting portion 82A and a light receiving portion 82B, a blocking portion 84A for shielding a light from the light emitting portion 82A is disposed.

The blocking portion 84A extends from a corner of a square plate-shaped press member 84, and one end of a spring 86 is attached to the backside of the press member 84. The other end of the spring 86 is attached to the innermost wall 12B of the main frame 12, and thus the spring 86 biases the press member 84 in the direction away from the innermost wall 12B.

As shown in FIG. 8A, by pressing the press member 84, the blocking portion 84A departs from the light path of the light emitting portion 82A, so that the light is emitted from the light emitting portion 82A to the light receiving portion 82B. When the process cartridge 52 is attached to the main frame 12, the projection 80 of the process cartridge 52 pushes the press member 84, and thereby the light is emitted from the light emitting portion 82A to the light receiving portion 82B. Thus, as shown in FIG. 7, a signal is sent to the control unit 78 connected to the light receiving portion 82B. The attachment of the process cartridge 52 to the main frame 12 is conformed in this manner.

Figure 9B:
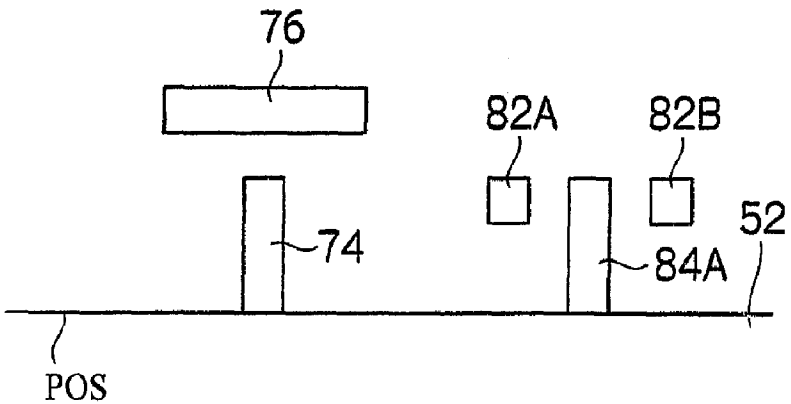
FIG. 9B is an explanatory view showing a positional relation for comparison with FIG. 9A.
Figure 9A:
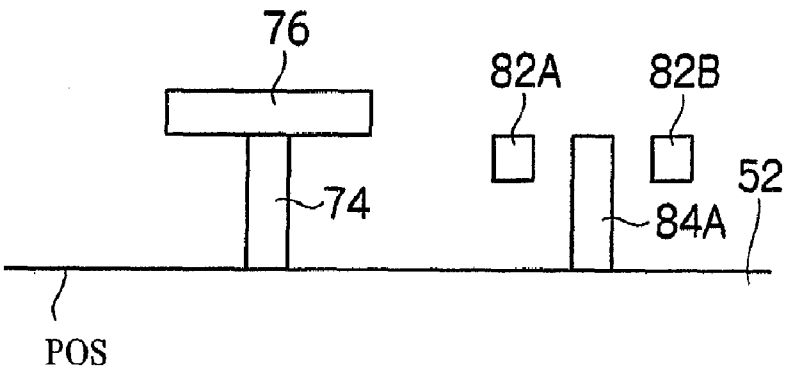
FIG. 9A is an explanatory view showing a positional relation between an information detecting unit and the existence detecting unit incorporated in the image forming apparatus according to the exemplary embodiment of the invention.

When the process cartridge 52 is attached to a wrong position, the engaging rib 64 abuts with the periphery of the engaging hole 72 so that movement of the process cartridge 52 is regulated (at a position POS shown in FIG. 9A).

This position POS is set such that the reading sensor 76 can comes into contact with the memory 74 and the information of the memory 74 can be read by the reading sensor 76, and the projection 80 is not in contact with the pressing member 84 and the blocking portion 84A is still positioned on the light path of the light emitting portion 82A so that the detection of "existence" of the process cartridge 52 is not carried out by the photointerruptor 82 (the process cartridge 52 is not detected). It should be noted that the components such as the reading sensor 76 are shown in FIG. 9A only schematically as a matter of convenience, and the reading sensor 76 may be a noncontact sensor though it is a contact sensor in this example.

Then, the operation of the image forming apparatus 10 having the above structure will be described below.

As shown in FIG. 1, the recording paper P is taken one-by-one from the paper feed cassette 46 by the feed roller pair 48, and is fed by the resist roller pair 49 onto the conveyance belt 34 at the predetermined timing. The recording paper P is electrostatically adsorbed to the conveyance belt 34, and is conveyed to the image carrier members 20Y to 20K for each color.

In each developing unit 16, the surface (the circumferential surface) of the image carrier member 20 is uniformly charged by the charge roller 22, thereafter, the surface (the circumferential surface) of the image carrier member 20 is scanned by a laser beam (image beam) irradiated from the optical box 24, so that an electrostatic latent image is formed on the surface (the circumferential surface) based on the image data. Thereafter, a toner is transferred to the image carrier member 20 by the developing roller 26, whereby a visible image is formed on the surface (the circumferential surface) of the image carrier member 20.

After the visible image is formed on the surface (the circumferential surface) of the image carrier member 20 in this manner, the toner image (the unfixed image) on the surface of the image carrier member 20 is transferred by the image carrier member 20 and the transfer roller 36 to the proceeding (passing) recording paper P, which is adsorbed onto and conveyed by the conveyance belt 34. The process is carried out with respect to each color of yellow (Y), magenta (M), cyan (C), and black (K) in this order, and when transferring the full color toner image (the unfixed image) onto the recording paper P, the recording paper P is conveyed to the fixing device 38 by the conveyance belt 34.

The recording paper P conveyed to the fixing device 38 is heated and pressurized by the heating roller 40 and the pressure roller 42 to fix the transferred, unfixed toner image thereon. Then, the recording paper P, on which the toner image is fixed by the fixing device 38, is discharged to the output tray 44. After the toner image is transferred to the recording paper P, the surface (the circumferential surface) of the image carrier member 20 is cleaned by the cleaning member 28 to prepare for the next image forming process.

When the recording paper P is jammed or maintenance of the developing unit 16 (supply of the toner) is carried out, the cover 14 is rotated in a direction away from the main frame 12 to open the developing unit 16 (the image carrier members 20). Then, after predetermined operation, the cover 14 is rotated toward the main frame 12 to close the developing unit 16 (the image carrier members 20).

In the embodiment of the invention, as shown in FIG. 5, different engaging ribs 64 are provided for each color on the backsides of the process cartridges 52. Further, as shown in FIG. 6, the engaging holes 72 corresponding to the engaging ribs 64 provided on the backsides of the process cartridges 52 are provided on the innermost wall 12B of the main frame 12. As a result, the attachment of the process cartridge 52 to the wrong position can be prevented.

The process cartridge 52 is attached to a proper set position thereof by the engaging rib 64 engaging with the engaging hole 72. When the process cartridge 52 is attached to a wrong position, the engaging rib 64 cannot engage with the engaging hole 72 (the engaging rib 64 interferes with the engaging hole 72), as the result, movement of the process cartridge 52 is regulated before the proper set position. Thus, operators can find that the process cartridge 52 is attached to an incorrect position.

On the other hand, in a case where the cover 14 is closed despite of the incorrect attachment of the process cartridge 52, there is a fear that a large force is applied to the process cartridge 52Y positioned in the vicinity of the rotation center of the cover 14 and the process cartridge 52Y is broken.

In the embodiment of the invention, the spring 56 is attached to the conveying unit 18 as shown in FIG. 4A, so that the conveying unit 18 is in a state of floating with respect to the cover 14. Thus, the conveying unit 18 can be moved from the process cartridges 52 side toward the cover 14, whereby the conveyance belt 34 can refuge (move) from the proper position (the virtual line Q) as shown in FIG. 4B. That is, the conveyance belt 34 is pressed by the process cartridges 52.

In other words, when the process cartridge 52 is not attached to the proper position and the cover 14 is closed, the conveying unit 18 is moved toward the cover 14 as shown in FIG. 4B, so that the cover 14 can be closed. Thus, the impact force more than or equal to the predetermined value is not applied to the process cartridge 52.

Therefore the process cartridge 52 is not broken. Further, the impact force resistance of the process cartridge 52 can be lowered, and a material for increasing the impact force resistance is not required for the process cartridge body 66, whereby the costs can be reduced.

The spring force of the springs 56 is set so as to be greater than the pressing force for attaching the process cartridges 52 into the proper positions, therefore, the process cartridges 52 can be pushed and attached to the proper positions by the operation of closing the cover 14.

The engaging rib 64 and the memory 74 are provided on the plate 68 and the plate 68 is replaceable (removable) from the process cartridge body 66 as shown in FIG. 5, therefore, the process cartridge body 66 can be commonly used for each of colors. Thus, the costs and stocks can be reduced by using the common large member.

In a case where the process cartridge 52 is attached to the wrong position, the engaging rib 64 abuts with the periphery of the engaging hole 72 and the movement of the process cartridge 52 is regulated. In this embodiment of the invention, as shown in FIG. 9A, at the position P, the information of the memory 74 can be read by the reading sensor 76, further, the projection 80 is not in contact with the press member 84 therefore the blocking portion 84A is still positioned on the light path of the light emitting portion 82A so that the detection of "existence" of the process cartridge 52 is not carried out by the photointerruptor 82.

For example, if, at a position where the movement of the process cartridge 52 is regulated when attaching the process cartridge 52 to the main frame 12, the information cannot be read by the reading sensor 76 (that is, the memory 74 is not in contact with the reading sensor 76 in a case of the contact type sensor, or the memory 74 is set in a position where electric wave from the reading sensor 76 cannot reach the memory 74 in a case of the non-contact type sensor), and the blocking portion 84A is still positioned on the light path of the light emitting portion 82A as shown in FIG. 9B, a state in which the process cartridge 52 is attached to the wrong position, that is, the process cartridge 52 is attached to the position of the wrong color, and a case in which the process cartridge 52 is not attached (forgetting to attach process cartridge 52), are detected as the same detection results.

While in this embodiment of the invention, the information of the memory 74 can be read by the reading sensor 76 even when the movement of the process cartridge 52 is regulated when attaching. Thus, a state in which the process cartridge 52 is attached to the wrong position and a case in which the process cartridge 52 is not attached can be detected as the different results.

Conventionally, detecting circuits are necessary for the respective process cartridges 52 in order to recognize that the process cartridge 52 is attached to a position of a wrong color. In the embodiment of the invention, it is possible to recognize that the process cartridge 52 is attached to a position of a wrong color by only one detecting circuit, resulting in reduction of electronic parts and costs.

Although both of the information detecting unit and the existence detecting unit are provided in the image forming apparatus in the embodiment, the apparatus may include only one of them. In this case, at the position where the movement of the process cartridge 52 is regulated when attaching, it is necessary that the information of the memory 74 cannot be read by the reading sensor 76, alternatively that the blocking portion 84A is still positioned on the light path of the light emitting portion 82A as a position in which the projection 80 does not abut the press member 84. In this case, it is possible at least to recognize that the process cartridge 52 is attached to the wrong position though it may be the case of forgetting to attach process cartridge 52.

What is claimed is:

1. An image forming apparatus comprising:

a plurality of process cartridges removably provided at and arranged in tandem manner in an apparatus main body;

a conveyance belt facing the process cartridges, that conveys a recording medium;

a cover member provided at the apparatus main body so as to be capable of opening and closing with respect to the apparatus main body, having a state in which the conveyance belt faces the process cartridges being released so that the process cartridges are exposed when the cover member is opened;

identified parts respectively provided at the process cartridges, at least one of shapes and placements thereof being different from each other for respective colors corresponding to the process cartridges;

identification parts provided at the apparatus main body so as to correspond to the respective identified parts, that show, when the process cartridges are attached at the apparatus main body, whether or not the process cartridges are attached at respective proper setting positions at the apparatus main body by interfering or not interfering with the respective identified parts; and a conveyance belt refuge member that allows the conveyance belt to move toward the cover member when the cover member is closed in a state in which at least one of the process cartridges is not attached at the proper setting position.

2. The image forming apparatus of claim 1, wherein the conveyance belt refuge member is a spring member that movably supports the conveyance belt with respect to the cover member.

3. The image forming apparatus of claim 2, wherein a spring force of the spring member is greater than a pressing force for attaching the process cartridges at the proper setting positions.

4. The image forming apparatus of claim 2, wherein:

one end of the spring member is connected to the conveyance belt side;

a joining portion is provided at the other end of the spring member; and a joined portion which can join with the joining portion is provided at the cover member.

5. The image forming apparatus of claim 1, wherein each of the identified parts is provided at a plate member that is removably attached to the respective process cartridge.

6. The image forming apparatus of claim 5, wherein:

an information supplying unit is provided at the plate member, the information supplying unit providing information relating to the process cartridge;

an information detecting unit is provided at the apparatus main body, the information detecting unit detecting the information of the information supplying unit; and the information detecting unit cannot detect the information when the process cartridge is not attached at the proper setting position.

7. The image forming apparatus of claim 6, wherein the information supplying unit is a memory that includes at least information concerning a toner color of the process cartridge, and the information detecting unit is a reading sensor that can read the information in the memory.

8. The image forming apparatus of claim 6, wherein existence or non-existence of the process cartridge is detected according to whether the information detecting unit can or cannot detect the information of the information supplying unit.

9. The image forming apparatus of claim 5, wherein:

an existence detecting unit is provided at the apparatus main body, the existence detecting unit detecting the existence or non-existence of the process cartridge; and not detecting the existence of the process cartridge if the process cartridge is not attached at the proper setting position.

10. The image forming apparatus of claim 9, wherein:

the existence detecting unit comprises a light emitting section, a light receiving section, and a blocking section provided at a pressed section that is pressed by the process cartridge; and the existence detecting unit detects whether or not the process cartridge is attached at the proper setting position by detecting whether or not the blocking section is located between the light emitting section and the light receiving section.

11. The image forming apparatus of claim 5, wherein:

an information supplying unit is provided at the plate member, the information supplying unit providing information relating to the process cartridge;

an information detecting unit is provided at the apparatus main body, the information detecting unit detecting the information of the information supplying unit;

an existence detecting unit is provided at the apparatus main body, the existence detecting unit detecting the existence or non-existence of the process cartridge; and if the process cartridge is not attached at the proper setting position, the information detecting unit detects the information of the information supplying unit, and the existence detecting unit does not detect the existence of the process cartridge.

12. The image forming apparatus of claim 11, wherein the information supplying unit is a memory that includes at least information concerning a toner color of the process cartridge, and the information detecting unit is a reading sensor that can read the information in the memory.

13. The image forming apparatus of claim 11, wherein:

the existence detecting unit comprises a light emitting section, a light receiving section, and a blocking section provided at a pressed section that is pressed by the process cartridge; and the existence detecting unit detects whether or not the process cartridge is attached at the proper setting position by detecting whether or not the blocking section is located between the light emitting section and the light receiving section.

14. The image forming apparatus of claim 1, wherein when the process cartridges are attached at the proper setting positions, the identification parts and the identified parts are engaged.

15. The image forming apparatus of claim 1, wherein the identified parts are one of an engaging protrusion and an engaged hole, and the identification parts are the other of the engaging protrusion and the engaged hole.

16. The image forming apparatus of claim 1, wherein the conveyance belt refuge member allows the conveyance belt to move toward the cover member by the conveyance belt being pressed by the process cartridge which is not attached at the proper setting position.

* * * * *